US008657281B2

(12) United States Patent
Nishitani et al.

(10) Patent No.: US 8,657,281 B2
(45) Date of Patent: Feb. 25, 2014

(54) SHEET CONVEYING APPARATUS, IMAGE RECORDING APPARATUS, AND IMAGE READING APPARATUS

(75) Inventors: Hitoshi Nishitani, Tokyo (JP); Gen Kitamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 12/437,918

(22) Filed: May 8, 2009

(65) Prior Publication Data

US 2009/0218755 A1 Sep. 3, 2009

Related U.S. Application Data

(62) Division of application No. 11/530,160, filed on Sep. 8, 2006, now Pat. No. 7,549,633.

(30) Foreign Application Priority Data

Sep. 15, 2005 (JP) ..... 2005-267909

(51) Int. Cl.
*B65H 1/00* (2006.01)
*B65H 1/08* (2006.01)
*B65H 1/06* (2006.01)

(52) U.S. Cl.
USPC ..... 271/162; 271/164; 271/165; 271/160; 271/131; 271/126

(58) Field of Classification Search
USPC ..... 271/157, 160, 164, 165, 162, 127, 131, 271/23
See application file for complete search history.

(56) References Cited

U.S. PATENT DOCUMENTS

| | | | | |
|---|---|---|---|---|
| 4,017,181 | A * | 4/1977 | Komaba et al. | 355/72 |
| 4,678,175 | A * | 7/1987 | Arldt et al. | 271/34 |
| 4,853,713 | A | 8/1989 | Piatt et al. | 346/134 |
| 5,201,511 | A * | 4/1993 | Kim | 271/127 |
| 5,882,004 | A | 3/1999 | Padget | 271/119 |

(Continued)

FOREIGN PATENT DOCUMENTS

| | | |
|---|---|---|
| JP | 63-154545 | 6/1988 |
| JP | 06115722 A * | 4/1994 |

(Continued)

OTHER PUBLICATIONS

Korean Office Action, issued by the Korean Patent Office, dated Oct. 30, 2007, in Korean Application No. 10-2006-0089143.

(Continued)

*Primary Examiner* — Luis A Gonzalez
(74) *Attorney, Agent, or Firm* — Fitzpatrick, Cella, Harper & Scinto

(57) ABSTRACT

A sheet feeding apparatus has a sheet accommodating unit for accommodating a sheet, the sheet accommodating unit being detachably mountable to the apparatus; a feeding unit for feeding the sheet from the sheet accommodating unit; a press-contact device for press-contacting the sheet in the sheet accommodating unit to the feeding unit; a guiding member provided in the sheet feeding apparatus for guiding the sheet accommodating unit such that sheet accommodated in the sheet accommodating unit is not contacted to the feeding unit when the sheet accommodating unit is mounted to the apparatus; a moving device for moving the guiding member to bring the sheet into contact to the feeding unit after the sheet accommodating unit is mounted to the apparatus.

8 Claims, 7 Drawing Sheets

(56) References Cited

U.S. PATENT DOCUMENTS

| | | | | |
|---|---|---|---|---|
| 6,246,466 | B1 | 6/2001 | Hirano et al. | 355/407 |
| 6,299,157 | B1 | 10/2001 | Lim | 271/117 |
| 2004/0036207 | A1 | 2/2004 | Lee et al. | 271/157 |
| 2004/0070143 | A1 | 4/2004 | Deshimaru et al. | 271/272 |

FOREIGN PATENT DOCUMENTS

| | | | | |
|---|---|---|---|---|
| JP | 08073060 | A | * | 3/1996 |
| JP | 8-208046 | | | 8/1996 |
| JP | 8-290836 | | | 11/1996 |
| JP | 09040194 | A | * | 2/1997 |
| JP | 2000-137837 | | | 5/2000 |
| JP | 2001294333 | A | * | 10/2001 |
| JP | 3302670 | | | 4/2002 |
| TW | 1220413 | | | 8/2004 |

OTHER PUBLICATIONS

Official Letter (English Translation)/Search Report, dated Jun. 5, 2009.

European Official Action dated Mar. 25, 2011, issued by the European Patent Office in European Patent Application No. 06 120 646.2.

* cited by examiner

SHEET CONVEYING APPARATUS, IMAGE RECORDING APPARATUS, AND IMAGE READING APPARATUS

This is a divisional of U.S. patent application Ser. No. 11/530,160, filed Sep. 8, 2006, and allowed Feb. 10, 2009.

FIELD OF THE INVENTION AND RELATED ART

The present invention relates to a sheet conveying apparatus in which a sheet storage means is removably mountable while holding sheets, an image recording apparatus employing said sheet conveying apparatus, and an image reading apparatus employing said sheet conveying apparatus.

An image forming apparatus or an image reading apparatus, such as a printer, a copying machine, a scanner, etc., employs a sheet conveying apparatus for feeding blank sheets of recording medium such as recording paper, or originals in the form of sheet, into the apparatus while separating them one by one. A sheet conveying apparatus employs a cassette which is a sheet storage means. The cassette is in the form of a box, and can be removably mountable while holding a stack of sheets. FIG. 9 is a vertical sectional view of a conventional sheet conveying apparatus, which is ready for sheet conveyance, FIG. 9, (a) showing a sheet conveyance apparatus structure in which a feed roller is disposed so that it will be below the stack of sheets after the mounting of the cassette into the sheet conveying apparatus, and FIG. 9, (*b*) showing a sheet conveying apparatus structure in which a feed roller is disposed so that it will be above the stack of sheets after the mounting of the cassette into the apparatus. In FIGS. 9, (*a*) and 9, (*b*), the stacks of sheets S stored in the cassettes 101 and 201, each of which is a boxy sheet storage means, are kept pressed upon feed rollers 102 and 202, each of which is a conveying means. As a feed roller is rotated by an unshown driving means, the sheets S are conveyed by the friction between the sheets S and feed rollers 102 and 202 in the directions indicated by arrow marks X and Y, respectively.

In the sheet conveying apparatuses shown in FIGS. 9, (*a*) and 9, (*b*), the cassettes 101 and 201 are mounted on a pair of guiding members 103 and a pair of guiding members 203, which guide the cassettes 101 and 201, respectively, so that the cassettes 101 and 201 can be pulled out, or inserted, in the direction intersectional to the sheet conveyance direction (direction perpendicular to sheet surface). The sheet conveying apparatuses are provided with pressure application plates 104 and 204, respectively, which are pressure applying means for keeping the stacks of sheets against the corresponding feed rollers. Whether a feed roller is positioned above the stack of sheets S as is the feeder roller 102, or below the stack of sheets S as is the feed roller 202, the friction generated between the feed roller and stack of sheets by the weight of the feed roller or stack of sheets alone is not enough to reliably convey the sheets. Therefore, a sheet conveying apparatus is generally provided with a pressure applying member, such as the springs 106 or 206, which applies pressure to at least the feed roller or pressure application plate 4, to keep the stack of sheets pressed upon the feed roller.

When it is necessary for a user to replenish the image recording apparatus with sheets of recording medium, the user is to pull the boxy cassettes 101 and 201 out of the sheet conveying apparatuses. Then, the user is to replenish the cassettes 101 and 201 with sheets and remount the cassettes 101 and 201. As for the direction in which a cassette is mounted or removed, there are cassettes which are to be mounted or removed in the directions indicated by arrow marks A and B, respectively, which are parallel to the sheet conveyance direction, and cassettes which are to be mounted or removed in the direction intersectional to the sheet conveyance direction (direction perpendicular to sheet surface). Both types of cassette have been put into production.

In order to generate the force for conveying the sheets during a sheet conveyance operation, the stack of sheets is kept pressed against the feed roller. However, if the stack of sheets is kept pressed against the feed roller when the cassette is removed, it requires a large amount of force to pull the cassette out of the sheet conveying apparatus, making it difficult to pull the cassette out, and also, increasing the possibility that the sheets will become jammed (paper jam) when the cassette is pulled out. Further, if the feed roller is in a position in which it interferes with the stack of sheets, the possibility that the sheets will jam when the cassette is mounted is higher. As a means for eliminating the above described problems, it is a common practice to keep the feed roller separated from the stack of sheets by retracting at least one of the feed roller and pressure application plate when pulling out the cassette. In Japanese Patent No. 3302670, a paper feeding apparatus equipped with a mechanism for moving the feed roller away from the stack of sheets is disclosed.

However, a method for moving the feed roller, which receives rotational driving force, away from the stack of sheets, requires a high level of accuracy for the positioning of the feed roller, in terms of the rotational axis of the feed roller. Further, the feed roller is required to be rigid enough to withstand not only the reactive force which is generated as it conveys sheets, but also, the pressure applied by the pressure application plate. Therefore, in order to put the above described method into practical use, a complicated mechanism such as the one recorded in Patent Document 1 is necessary. In comparison, a method which retracts the pressure application plate instead of the feed roller can be easily put to practical use with the employment of a relatively simple mechanism. However, this method suffers from the following problem. That is, if the feed roller is disposed, as is the feed roller 102 shown in FIG. 9, (a), so that it will be below the stack of sheets after the mounting of the cassette, the stack of sheets rests on the feed roller due to its own weight, even if the pressure application plate 104 is retracted upward. Therefore, it is highly possible that the sheets will jam when the cassette 101 is mounted or removed. In other words, it is difficult to eliminate the above described problems.

SUMMARY OF THE INVENTION

The present invention was made in consideration of the above described technical problems. The primary object of the present invention is to provide a sheet conveying apparatus, an image recording apparatus, and an image reading apparatus, which are simple in structure and allow their sheet storage means to be easily mounted or dismounted, even though their sheet conveying means are fixed in position relative to their sheet storage means.

According to an aspect of the present invention, there is provided a sheet feeding apparatus comprising sheet accommodating means for accommodating a sheet, said sheet accommodating means being detachably mountable to said apparatus; feeding means for feeding the sheet from said sheet accommodating means; press-contact means for press-contacting the sheet in said sheet accommodating means to said feeding means; a guiding member for guiding said sheet accommodating means such that sheet accommodated in said sheet accommodating means is not contacted to said feeding means when said sheet accommodating means is mounted to said apparatus; moving means for moving said guiding member to bring the sheet into contact to said feeding means after said sheet accommodating means is mounted to said apparatus.

According to the present invention, it is possible to provide a sheet conveying apparatus, an image recording apparatus, and an image reading apparatus, which are simple in structure and allow their sheet storage means to be easily mounted or dismounted, even through their sheet conveying means are fixed in position relative to their sheet storage means.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 1, (b) is a vertical sectional view of the sheet conveying apparatus, in one of the preferred embodiments of the present invention, which is in the state in which the movable members have been retracted, allowing the stack of sheets to be pressed upon the feed roller so that the sheets can be conveyed.

FIG. 2, (b) is a sectional view of the sheet conveying apparatus, shown in FIG. 1, which is in the state in which the cassette 1 is being mounted into the sheet conveying apparatus.

FIG. 2, (*c*) is a cross-sectional view (at line C-C in FIG. 1, (*a*)) of the sheet conveying apparatus, shown in FIG. 1, which is in the state in which the cassette 1 has been completely inserted into the sheet conveying apparatus.

FIG. 2, (*d*) is a cross-sectional view (at line C-C in FIG. 1, (*b*)) of the sheet conveying apparatus, shown in FIG. 1, which is in the state in which the movable members have been retracted.

FIG. 9, (b) is a vertical sectional view of a conventional sheet conveying apparatus structured so that its feed roller will be above the stack of sheets after the amounting of its sheet storage means.

DETAILED DESCRIPTION OF THE PREFERRED EMBODIMENTS

Figure 1:
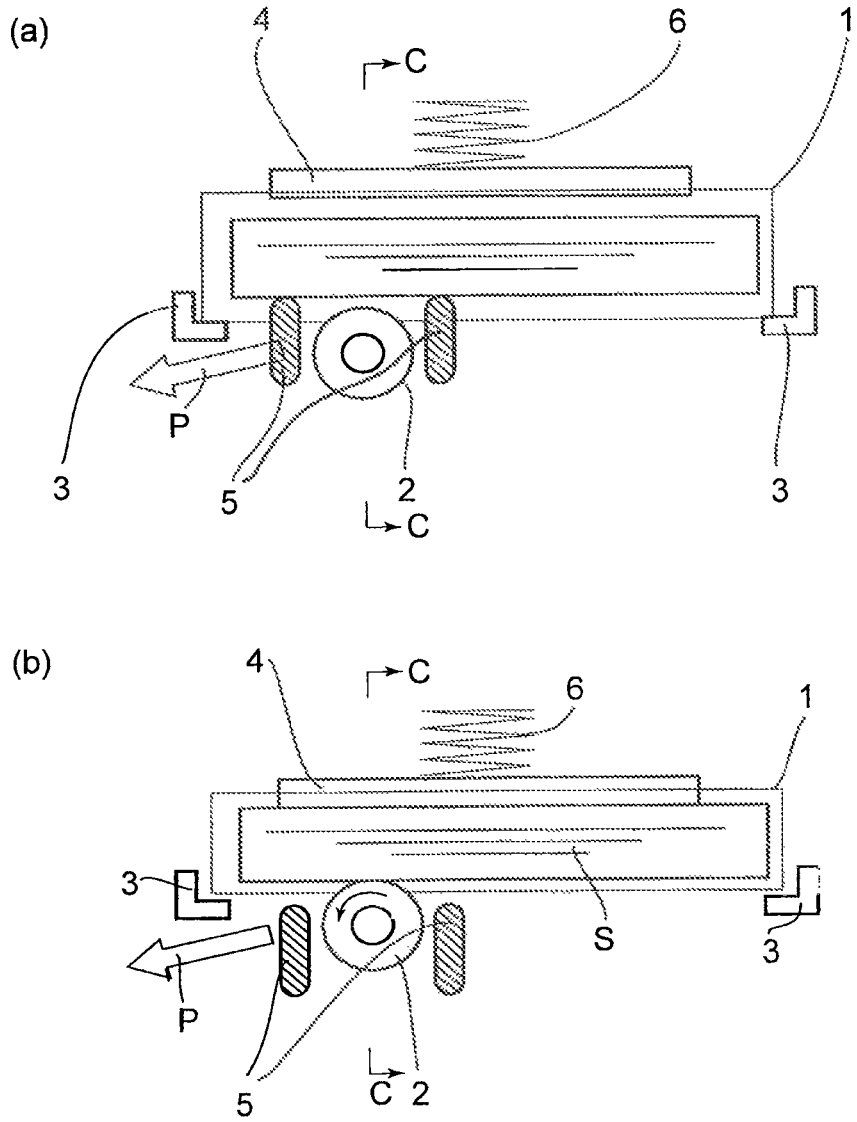
FIG. 1, (a) is a vertical sectional view of the sheet conveying apparatus, in one of the preferred embodiments of the present invention, which is in the state in which the movable members are protruding higher than the feed roller, lifting thereby the stack of sheets away from the feed roller.

Hereinafter, the preferred embodiments of the present invention will be concretely described with reference to the appended drawings. Incidentally, if a given component, section thereof, or the like in one of the drawings is the same in referential numeral or character as the component, section thereof, or the like in another drawing, they are identical or correspond to each other. FIG. 1 is a vertical sectional view of the sheet conveying apparatus in one of the preferred embodiments of the present invention, FIG. 1, (a) showing the sheet conveying apparatus which is in the state in which the movable members 5 (sheet guiding members) are in contact with the stack of sheets mounted in the cassette 1, and FIG. 1, (b) showing the sheet conveying apparatus which is in the state in which the feed roller 2 is in contact with the stack of sheets mounted in the cassette 1. In FIG. 1, designated by a referential numeral 1 is a cassette, which is a sheet storage means in which sheets S are stored in stack, and designated by a referential numeral 2 is a feed roller, which is a conveying means disposed below the cassette 1 to convey the sheets stacked in the cassette 1 while separating the sheets S one by one. The cassette 1 is resting on a pair of guiding members 3 (guiding means) disposed on the front and rear (in terms of sheet conveying direction), one for one, of the cassette placement space to guide the cassette 1 in the direction intersectional (normally, perpendicularly) to the sheet conveyance direction when the cassette 1 is mounted into the sheet conveying apparatus, or removed therefrom.

The sheet conveying apparatus is provided with a pressure application plate 4, which is a pressure applying means for pressing the sheets S stacked in the cassette 1 upon the feed roller 2. The pressure application plate 4 is disposed on the opposite side of the cassette 1 from the feed roller 2; it is disposed so that it will be above the stack of sheets S after the mounting of the cassette 1. The pressure application plate 4 is kept pressed toward the feed roller 2 by a spring 6, which is a means for applying downward pressure. The state of the pressure application plate 4 can be switched between two states: the state in which the stack of sheets S is kept pressed upon the feed roller 2 by the pressure generated by the spring 6, and the state in which the stack of sheets S is not pressed upon the feed roller 2. The sheet conveying apparatus is also provided with a pair of movable members 5, which are vertically movable and are disposed in the adjacencies of the feed roller 2. Each movable member 5 is in the form of a piece of plate or a rib, which extends in the direction intersectional to the sheet conveyance direction.

The pair of movable members 5 is movable between the contact position (top position) in which it is higher in position than the feed roller 2 and is in contact with the bottom surface of the stack of sheets, and the retract position (bottom position) in which it is lower in position than the feed roller 2 and remains separated from the bottom surface of the stack of sheets. The pair of movable members 5 is moved by a driving means such as a solenoid controlled by an unshown controlling means. The bottom wall of the cassette 1 is provided with an opening (unshown) for allowing the feed roller 2 and movable members 5 to come into contact with the bottom surface of the stack of sheets S. When the pair of movable members 5 is in the contact position, it supports the stack of sheets S against the force applied to the pressure application plate 4 by the spring 6. When the pair of movable members 5 is in the retract position, it allows the stack of sheets S to be pressed upon the feed roller 2 by the force applied to the pressure application plate 5 by the spring 6, making it possible for the stack of sheets S to be conveyed.

That is, the pressure application plate 4 and the pair of movable members 5 of the sheet conveying apparatus in this embodiment are structured to be controllable in their states so that their states can be switched between the state shown in FIG. 1, (a) and the state shown in FIG. 1, (b) by the function of the unshown controlling means. FIG. 1, (a) shows the state in which feed roller 2 is separated from the stack of sheets S, making it easier for the cassette 1 to be mounted or dismounted. FIG. 1, (b) shows the state in which the feed roller 2 is kept pressed upon the stack of sheets S, making the sheet conveying operation possible. An arrow mark P in FIG. 1, (b) indicates the direction in which the sheets S are conveyed as the feed roller 2 is rotated in the direction (counterclockwise direction of drawing) indicated by another arrow mark.

Incidentally, the sheet conveying apparatus in this embodiment is employable as a means for supplying objects, such as recording medium (for example, recording paper) or original, which is in the form of a sheet, to an image formation station or image reading station, in the wide range of apparatuses. For example, it is usable as the sheet conveying apparatus for a printer, a copying machine, facsimile machine, scanner, and a multi-functional machine or system made up of the combination of the preceding machines. That is, the sheet conveying apparatus in this embodiment can be employed by an image recording apparatus for recording an image on a sheet of recording medium with the use of a recording means based on image formation information, and such employment yields the same functional effects as those described above. Further, the sheet conveying apparatus in this embodiment can be employed by an image reading apparatus for reading the image formed on a sheet of recording medium, with the use of a reading means, and such employment also yields the same functional effects as those described above.

Figure 2:
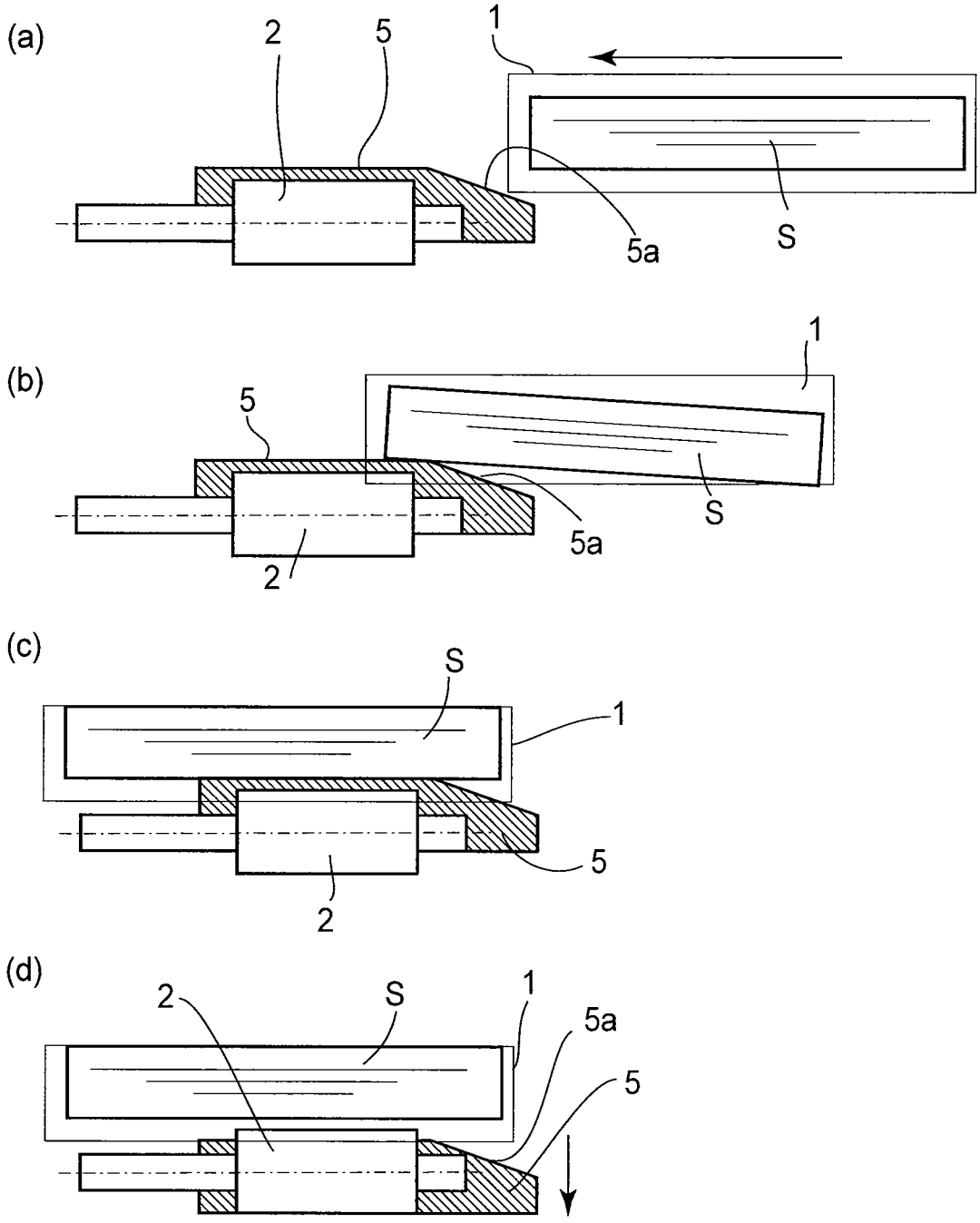
FIG. 2, (a) is a sectional view of the sheet conveying apparatus, shown in FIG. 1, which is in the state in which the cassette 1 has just begun to be mounted.

FIG. 2 is a cross-sectional view of the sheet conveying apparatus, shown in FIG. 1, at a line C-C in FIG. 1. FIGS. 2, (*a*) and 2, (*b*) show the sheet conveying apparatus, which is in the state in which the sheet storage means is in the process of being mounted. FIG. 2, (c) shows the sheet conveying apparatus, which is in the state in which the insertion of the sheet storage means has been completed and the pair of movable members 5 in the position in which it protrudes higher than the feed roller 2 to contact the stack of sheets S. FIG. 2, (d) shows the sheet conveying apparatus, which is in the state in which the insertion of the sheet storage means has been completed and the movable members have been retracted to allow the stack of sheets S to be pressed upon the feed roller 2. Next, referring to FIG. 2, the operation for mounting the cassette 1, which is the sheet storage means of the sheet conveying apparatus in this embodiment, and the operation for pulling out the cassette 1, will be described. Incidentally, as shown in FIG. 2, each of the movable members 5, which is in the form of a piece of plate, is provided with a tapered portion 5*a*, which constitutes the upstream end of the movable member 5 in terms of the direction in which the cassette 5 is mounted (direction intersectional to sheet conveyance direction). The tapered portion 5*a* is shaped so that its height gradually reduces toward the upstream end of the movable member.

Referring to FIG. 2, when mounting the cassette 1, the pair of movable members 5 is protruding higher than the feed roller 2 as shown in FIG. 2, (a). With the pair of movable members 5 remaining in this state, the cassette 1 is inserted in the direction indicated by an arrow mark. As the cassette 1 is inserted along the tapered portion 5*a*, the top surface of each movable member 5 comes into contact with the bottom surface of the stack of sheets S through the opening (unshown) with which the bottom wall of the cassette 1 is provided, as shown in FIG. 2, (b) which shows the sheet conveying apparatus in the state in which the cassette 1 is being inserted, with the stack of sheets S being lifted by the top surface of each movable member 5 (which includes the top surface of the tapered portion 5*a*), being thereby separated from the feed roller 2. Therefore, the cassette 1 can be inserted without allowing the stack of sheets S to interfere with the feed roller 2.

FIG. 2, (c) shows the sheet conveying apparatus in the state in which the insertion of the cassette 1 has been completed. At the end of the insertion of the cassette 1, the pair of movable members 5 is protruding higher than the feed roller 2, keeping thereby the stack of sheets S separated from the feed roller 2. When it is time for conveying the sheets S, the pair of movable members 5 is to be moved in the direction (downward) indicated by an arrow mark so that it retracts lower than the top portion of the feed roller 2, as shown in FIG. 2, (d). When the sheet conveying apparatus is in the state shown in FIG. 2, (d), the stack of sheets S in the cassette 1 is pressed upon the feed roller 2 by the function of the pressure application plate 4 (FIG. 1) which is under the pressure from the spring 6, making the sheet conveying operation possible.

In order to pull out the cassette 1 from the sheet conveying apparatus, the pair of movable members 5 is to be moved upward by the control operation of the controlling means to put the pair of movable members 5 again in the state shown in FIG. 2, (c), in which it protrudes higher than the feed roller 2. When the pair of movable members 5 is in this state, the stack sheets S remains separated from the feed roller 2, and therefore, the cassette 1 can be easily and quickly pulled out of the sheet conveying apparatus, without causing the sheets S to jam. That is, the cassette 1 can be easily removed from the sheet conveying apparatus through the state shown in FIG. 2, (b) and the state shown in FIG. 1, (a), that is, following in reverse the steps followed for the insertion.

Figure 3:
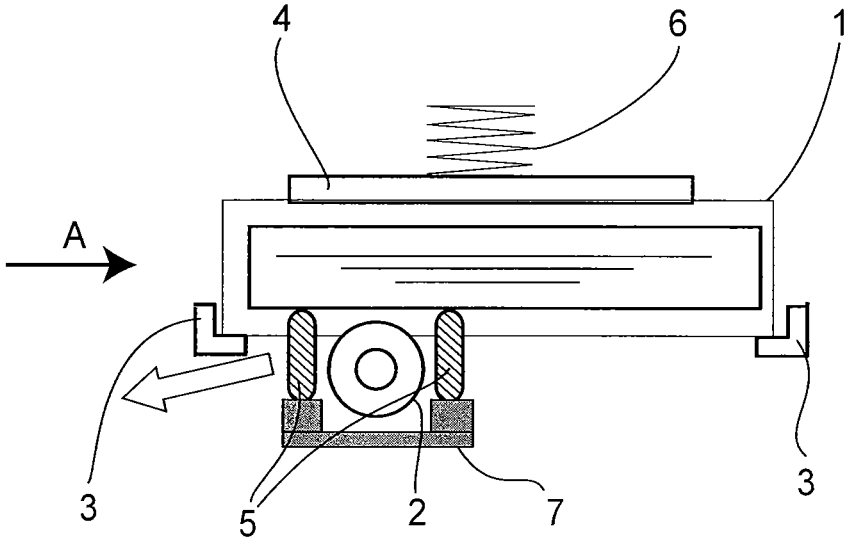
FIG. 3 is a sectional view of the sheet conveying apparatus, showing the function of the cam for placing the sheet conveying apparatus in the state shown in FIG. 1, (a).
Figure 4:
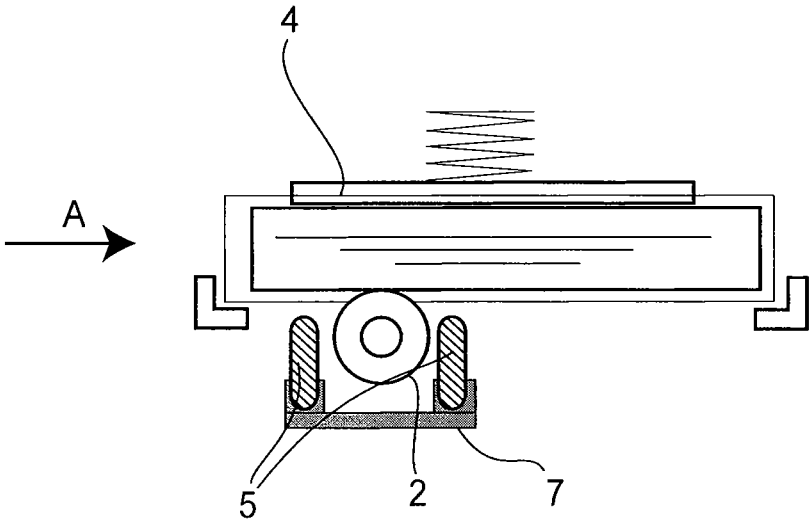
FIG. 4 is a sectional view of the sheet conveying apparatus, which is in the state in which the cam, which was in the state shown in FIG. 3, has been moved into the position in which it is inactive.
Figure 5:
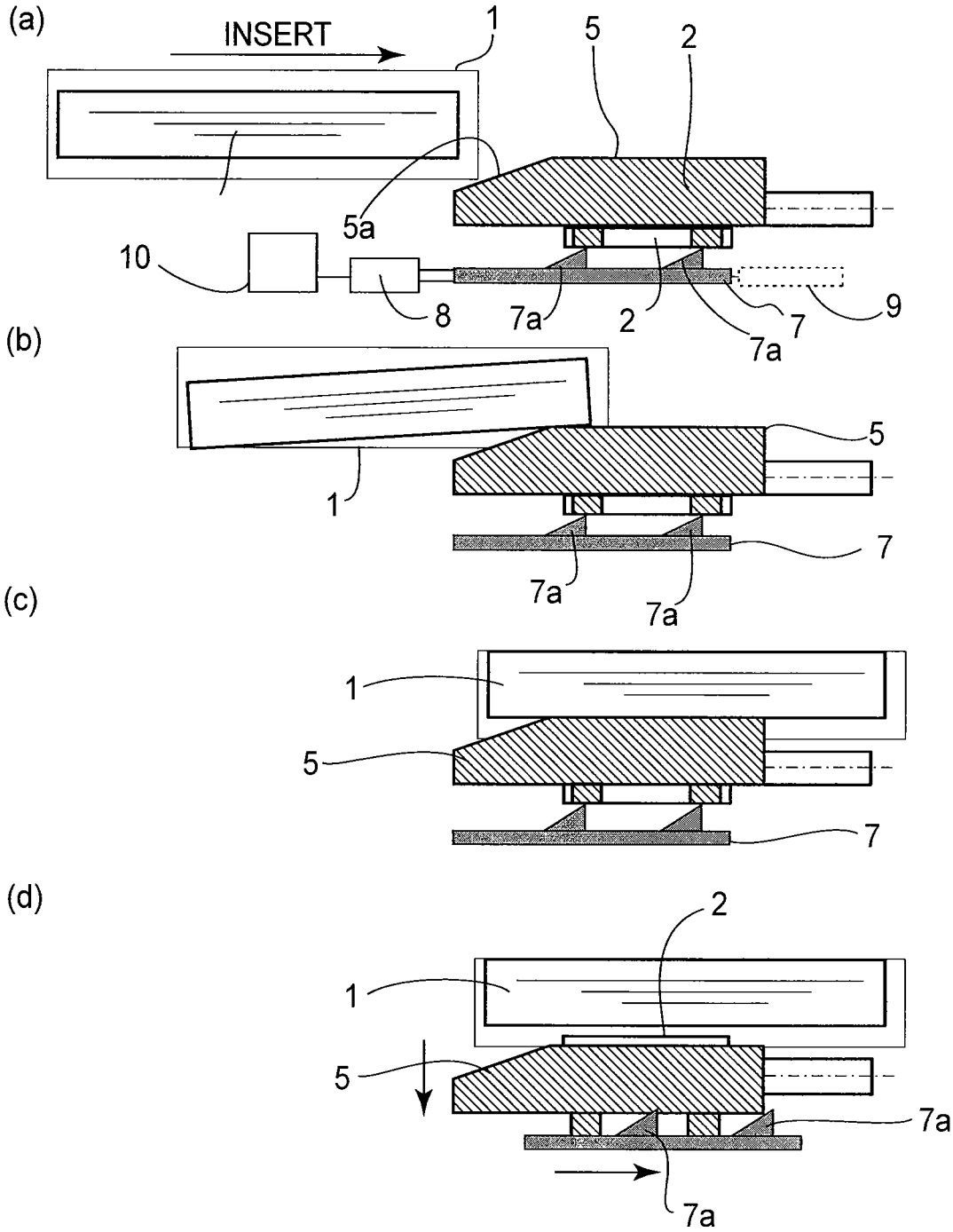
FIGS. 5, (*a*); 5, (*b*); 5, (*c*); and 5, (*d*) are sectional views of the sheet conveying apparatus, which correspond to FIGS. 2, (*a*); 2, (*b*); 2, (*c*) and 2, (*d*), respectively, showing the functions of the cam.

FIGS. 3-5 show the sheet conveying apparatus in accordance with the present invention, in which the pair of movable members 5 is moved by a movable member moving means made up of a cam and solenoid.

In FIGS. 3-5, designated by a referential numeral 7 is a cam. The cam 7 has cam faces 7*a* which push up the movable members 5 by coming into contact with the corresponding movable member 5. Designated by a referential numeral 8 is a solenoid for moving the cam 7. As the solenoid is excited, it moves the cam 7 leftward of FIG. 5, pushing thereby the corresponding movable member 5 upward. Designated by a referential numeral 9 is a return spring, which pulls the cam 7 into its home position as the solenoid 8 is turned off. Designated by a referential numeral 10 is a control circuit for controlling the solenoid 8.

When mounting the cassette 1, the solenoid 8 is to be excited by a signal from the control circuit 10 to move the cam 7 leftward against the resiliency of the return spring 9, as shown in FIG. 5, (a). As the cam 7 is moved leftward, the corresponding movable member 5 is moved upward by the cam faces 7*a*, into the guiding positions in which it guides the stack of sheets S in the cassette 1 so that the stack of sheets S does not come into contact with the peripheral surface of the feed roller 2 while the cassette 1 is inserted. When each of the movable members 5 is in the guiding position, the top surface of each guiding member 5 is positioned higher than the peripheral surface of the feed roller 2.

Referring to FIG. 5, (b), as the cassette 1 is inserted, while being guided by the guiding members 3, into the sheet conveying apparatus, the pair of movable members 5 and feed roller 2 enters the cassette 1 through the opening 1*a* with which the bottom wall of the cassette 1 is provided.

Figure 6:
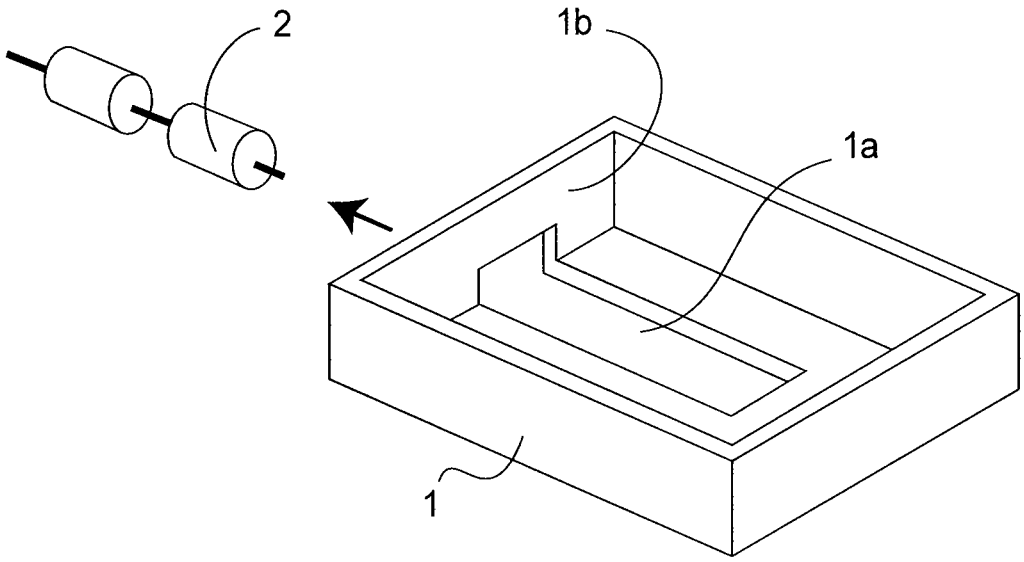
FIG. 6 is a perspective view of the feed roller and cassette, showing their positional relationship immediately before the mounting of the cassette.
Figure 7:
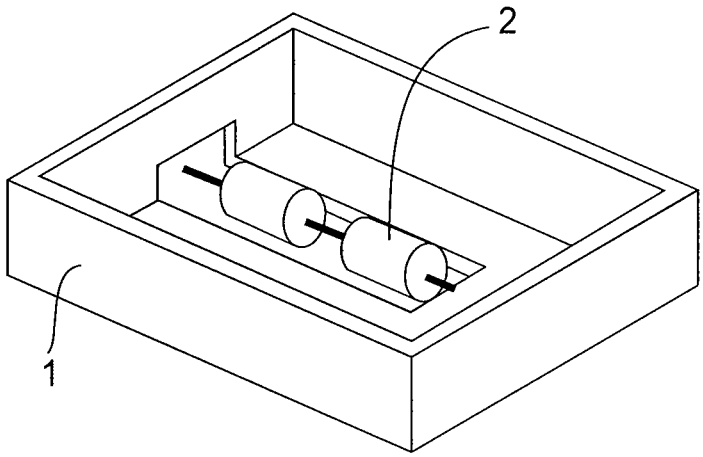
FIG. 7 is a perspective view of the feed roller and cassette, showing their positional relationship after the mounting of the cassette.

The stack of sheets S in the cassette 1 is guided by the tapered portion 5*a* of each movable member 5, without coming into contact with the feed roller 2, and rests on the pair of movable members 5 as shown in FIGS. 3 and 5, (c). Referring to FIG. 6, the cassette 1 has a wall 1*b* which makes up the four lateral walls of the cassette 1. Therefore, as any of the sheets in the cassette 1 is slightly displaced in a certain direction, the corresponding edge of the sheet comes into contact with the wall 1*a*, preventing the sheet from being further displaced. Therefore, the sheets S in the cassette 1 remain stacked in the cassette 1.

As the cassette 1 is moved into the preset operational position in the sheet conveying apparatus, that is, as the mounting of the cassette 1 is completed, the solenoid 8 is turned off by the control circuit 10. As the solenoid 8 is turned off, the cam 7 is returned to the home position by the return spring 9. As a result, the pair of movable members 5 moves downward, allowing the stack of sheets S to come into contact with the feed roller 2, as shown in FIGS. 4, 5, (*d*), and 7.

Figure 8:
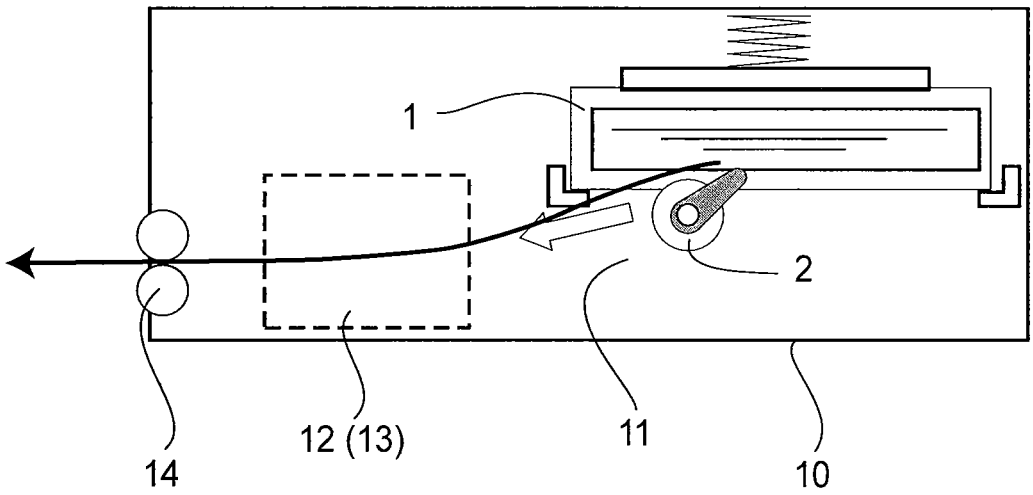
FIG. 8 is a schematic sectional view of an image forming apparatus or an image reading apparatus, which is in accordance with the present invention.
Figure 9:
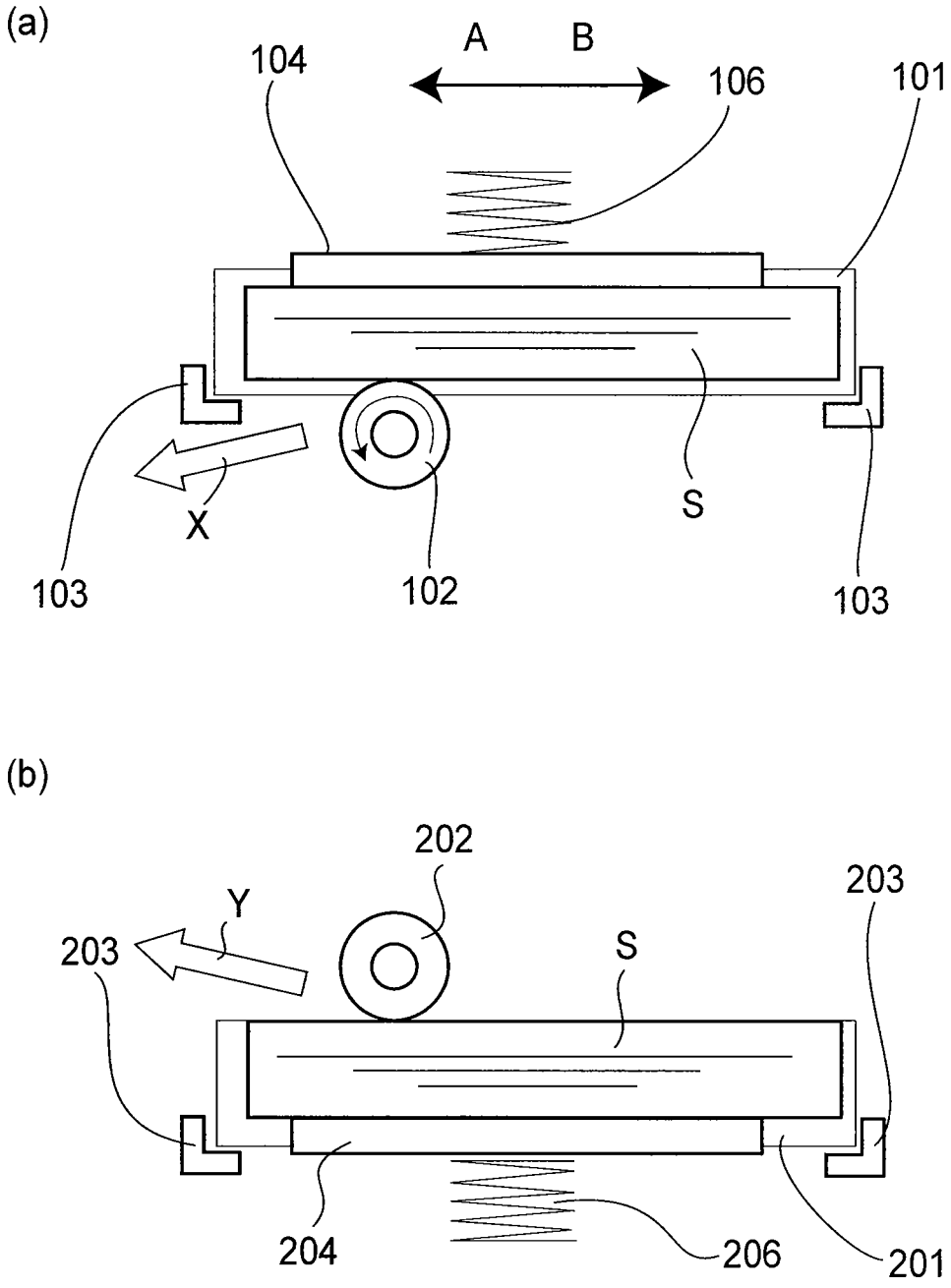
FIG. 9, (a) is a vertical sectional view of a conventional sheet conveying apparatus structured so that its feed roller will be below the stack of sheets after the mounting of its sheet storage means.

FIG. 8 is a schematic sectional view of an image forming apparatus or an image reading apparatus, which is in accordance with the present invention.

Designated by a referential numeral 10 in FIG. 8 is an image forming apparatus or an image reading apparatus.

Designated by a referential numeral 11 is the sheet conveying apparatus described with reference to FIGS. 3-7. Designated by a referential numeral 12 is an image formation station which forms an image on the sheet conveyed by the sheet conveying apparatus 11. Designated by a referential numeral 14 is a pair of discharge rollers which discharges the sheet, on which an image has been formed by the image formation station 12, from the image forming apparatus 10.

In the case of an image reading apparatus, an image reading station 13 is disposed in place of the image formation station 12. The image reading station reads the image on the sheet conveyed by the sheet conveying apparatus 11.

As described in the foregoing, according to the embodiments of the present invention, the sheet feeding apparatus includes sheet accommodating means for accommodating a sheet, said sheet accommodating means being detachably mountable to said apparatus; feeding means for feeding the sheet from said sheet accommodating means; press-contact means for press-contacting the sheet in said sheet accommodating means to said feeding means; a guiding member for guiding said sheet accommodating means such that sheet accommodated in said sheet accommodating means is not contacted to said feeding means when said sheet accommodating means is mounted to said apparatus; moving means for moving said guiding member to bring the sheet into contact to said feeding means after said sheet accommodating means is mounted to said apparatus.

Therefore, the sheet accommodating means can be mounted to or demounted from the apparatus without jamming of the sheet.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 267909/2005 filed Sep. 15, 2005 which is hereby incorporated by reference.

What is claimed is:

1. A sheet feeding apparatus comprising:

a sheet accommodating unit for accommodating sheets, said sheet accommodating unit being detachably mountable to said sheet feeding apparatus by insertion along an inserting path in a predetermined inserting direction;

a feeding roller for feeding the sheet from said sheet accommodating unit;

a first guiding member and second guiding member provided in the sheet feeding apparatus, for contacting the sheet accommodated in the sheet accommodating unit to keep the sheet out of contact with said feeding roller when said sheet accommodating unit is inserted along the inserting path; and a moving unit for moving the first guiding member and the second guiding member to a position where the first and second guiding members do not contact the sheet accommodated in the sheet accommodating unit after said sheet accommodating unit is mounted to said sheet feeding apparatus, wherein the predetermined inserting direction crosses with a direction in which the sheet is fed by the feeding roller, and the feeding roller is positioned between the first and second guiding members, and wherein the sheet accommodating unit has a lateral wall which is provided with an opening, and the first and second guiding members and the feeding roller enter the sheet accommodating unit through the opening when said sheet accommodating unit is inserted along the inserting path.

2. The sheet feeding apparatus according to claim 1, further comprising a third guiding member for guiding said sheet accommodating unit in a direction parallel with a rotation axis of said feeding roller when said sheet accommodating unit is mounted to said sheet feeding apparatus.

3. The sheet feeding apparatus according to claim 1, wherein said feeding roller is fixed in position relative to said sheet accommodating unit when said sheet accommodating unit is mounted to the sheet feeding apparatus.

4. The sheet feeding apparatus according to claim 1, wherein said feeding roller is disposed below said sheet accommodating unit, and when said sheet accommodating unit is mounted, said first and second guiding members guide the sheet in said sheet accommodating unit such that sheet accommodated in said sheet accommodating unit moves above said feeding roller.

5. The sheet feeding apparatus according to claim 1, wherein said first and second guiding members guide the sheet until said sheet accommodating unit is completely mounted to said sheet feeding apparatus.

6. The sheet feeding apparatus according to claim 1, wherein said moving unit moves said first and second guiding members such that the sheet is brought into contact with said feeding roller after said sheet accommodating unit is completely mounted to said sheet feeding apparatus.

7. An image forming apparatus comprising:

a sheet accommodating unit for accommodating sheets, said sheet accommodating unit being detachably mountable to said image forming apparatus by insertion along an inserting path in a predetermined inserting direction;

a feeding roller for feeding the sheet from said sheet accommodating unit;

a first guiding member and second guiding member provided in the image forming apparatus, for contacting the sheet in the sheet accommodating unit to keep the sheet out of contact with said feeding roller when said sheet accommodating unit is mounted to said image forming apparatus;

a moving unit for moving the first guiding member and the second guiding member such that the sheet contacts said feeding roller; and an image forming unit for forming an image on the sheet fed by said feeding unit, wherein the predetermined inserting direction crosses with a direction in which the sheet is fed by the feeding roller, and the feeding roller is positioned between the first and second guiding members, and wherein the sheet accommodating unit has a lateral wall which is provided with an opening, and the first and second guiding members and the feeding roller enter the sheet accommodating unit through the opening when said sheet accommodating unit is inserted along the inserting path.

8. An image reading apparatus comprising:

a sheet accommodating unit for accommodating a sheet, said sheet accommodating unit being detachably mountable to said image reading apparatus by insertion along an inserting path in a predetermined inserting direction;

a feeding roller for feeding the sheet from said sheet accommodating unit;

a first guiding member and second guiding member provided on the image reading apparatus, for contacting the sheet in said sheet accommodating unit such that the sheet accommodated in said sheet accommodating unit is not contacted to said feeding roller when said sheet accommodating unit is inserted along the inserting path;

a moving unit for moving the first guiding member and the second guiding member such that the sheet contacts said feeding roller after said sheet accommodating unit is mounted to said sheet feeding apparatus; and an image reading unit for reading an image on the sheet fed by said feeding unit, wherein the predetermined inserting direction crosses with a direction in which the sheet is fed by the feeding roller, and the feeding roller is positioned between the first and second guiding members, and wherein the sheet accommodating unit has a lateral wall which is provided with an opening, and the first and second guiding members and the feeding roller enter the sheet accommodating unit through the opening when said sheet accommodating unit is inserted along the inserting path.

* * * * *